US006170907B1

(12) United States Patent
Tsai

(10) Patent No.: US 6,170,907 B1
(45) Date of Patent: Jan. 9, 2001

(54) COLLAPSIBLE CHAIR

(76) Inventor: Ming-Liang Tsai, 4F-3, No. 8, Chin Street, Taipei (TW)

( * ) Notice: Under 35 U.S.C. 154(b), the term of this patent shall be extended for 0 days.

(21) Appl. No.: 09/365,746

(22) Filed: Aug. 3, 1999

(51) Int. Cl.[7] ..... A47C 4/00
(52) U.S. Cl. ..... 297/16.1; 297/45
(58) Field of Search ..... 297/16.1, 16.2, 297/45, 59

(56) References Cited

U.S. PATENT DOCUMENTS

| | | | | |
|---|---|---|---|---|
| 398,943 | * | 3/1889 | Crandall | 297/45 |
| 1,738,473 | * | 12/1929 | Green | 297/45 |
| 1,942,112 | * | 1/1934 | McQuilkin | 297/45 |
| 1,957,286 | * | 5/1934 | Olson | 297/45 |
| 2,104,255 | * | 1/1938 | Garbaccio | 297/45 |
| 3,124,387 | * | 3/1964 | MacLaren | 297/16.2 |
| 4,008,918 | * | 2/1977 | Cooper et al. | 297/16.1 |
| 5,058,950 | * | 10/1991 | Mann | 297/16.2 X |
| 5,570,928 | * | 11/1996 | Staunton et al. | 297/45 X |
| 5,934,747 | * | 8/1999 | Garland | 297/440.22 X |

* cited by examiner

*Primary Examiner*—Peter M. Cuomo
*Assistant Examiner*—Stephen Vu
(74) *Attorney, Agent, or Firm*—Rosenberg, Klein & Lee

(57) ABSTRACT

A collapsible chair includes two front legs and two rear legs. Two stiles telescopically received in the rear legs and may be moved to an extended position to form a back of the chair. A collar is movably fit over each leg. A pair of pivoted links is connected between every two adjacent legs. Each link has a first end pivotally attached to one of the two legs and a second end pivotally attached to the collar of the other one of the two legs whereby the chair is collapsed by moving the collars along the legs and the legs converge together. A flexible sheet is releasably fixed to top ends of the legs for serving as a seat. The flexible sheet may be removed from the chair when the chair is collapsed and the collapsed chair may be wrapped by the removed sheet thereby significantly reducing the space occupied by the collapsed chair.

4 Claims, 7 Drawing Sheets

COLLAPSIBLE CHAIR

FIELD OF THE INVENTION

The present invention generally relates to a chair, and in particular to a collapsible chair.

BACKGROUND OF THE INVENTION

A chair usually comprises four legs, including two front legs and two rear legs, supporting a seat. Some of the chairs have stiles extending from the rear legs to form a back. No matter a chair has a back or not, the conventional chair is fixed and cannot be collapsed or folded. Thus, the conventional chairs take a great amount of space and are difficult to move. A folding chair comprises legs hinged to each other and the seat thereby allowing partial collapse thereof. However, the collapsed folding chair still occupies a substantial amount of space and the problems discussed above remain.

Thus, it is desired to provide a collapsible chair that overcomes the above problems.

SUMMARY OF THE INVENTION

Accordingly, an object of the present invention is to provide a collapsible chair that may be collapsed when not in use for saving space.

Another object of the present invention is to provide a collapsible chair that is capable of complete collapse for occupying a minimum amount of space.

A further object of the present invention is to provide a collapsible chair that is fully collapsible for facilitating movement thereof.

To achieve the above object, in accordance with the present invention, there is provided a collapsible chair comprising two front legs and two rear legs. Two stiles telescopically received in the rear legs and may be moved to an extended position to form a back of the chair. A collar is movably fit over each leg. A pair of pivoted links is connected between every two adjacent legs. Each link has a first end pivotally attached to one of the two legs and a second end pivotally attached to the collar of the other one of the two legs whereby the chair is collapsed by moving the collars along the legs and the legs converge together. A flexible sheet is releasably fixed to top ends of the legs for serving as a seat. The flexible sheet may be removed from the chair when the chair is collapsed and the collapsed chair may be wrapped by the removed sheet thereby significantly reducing the space occupied by the collapsed chair.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
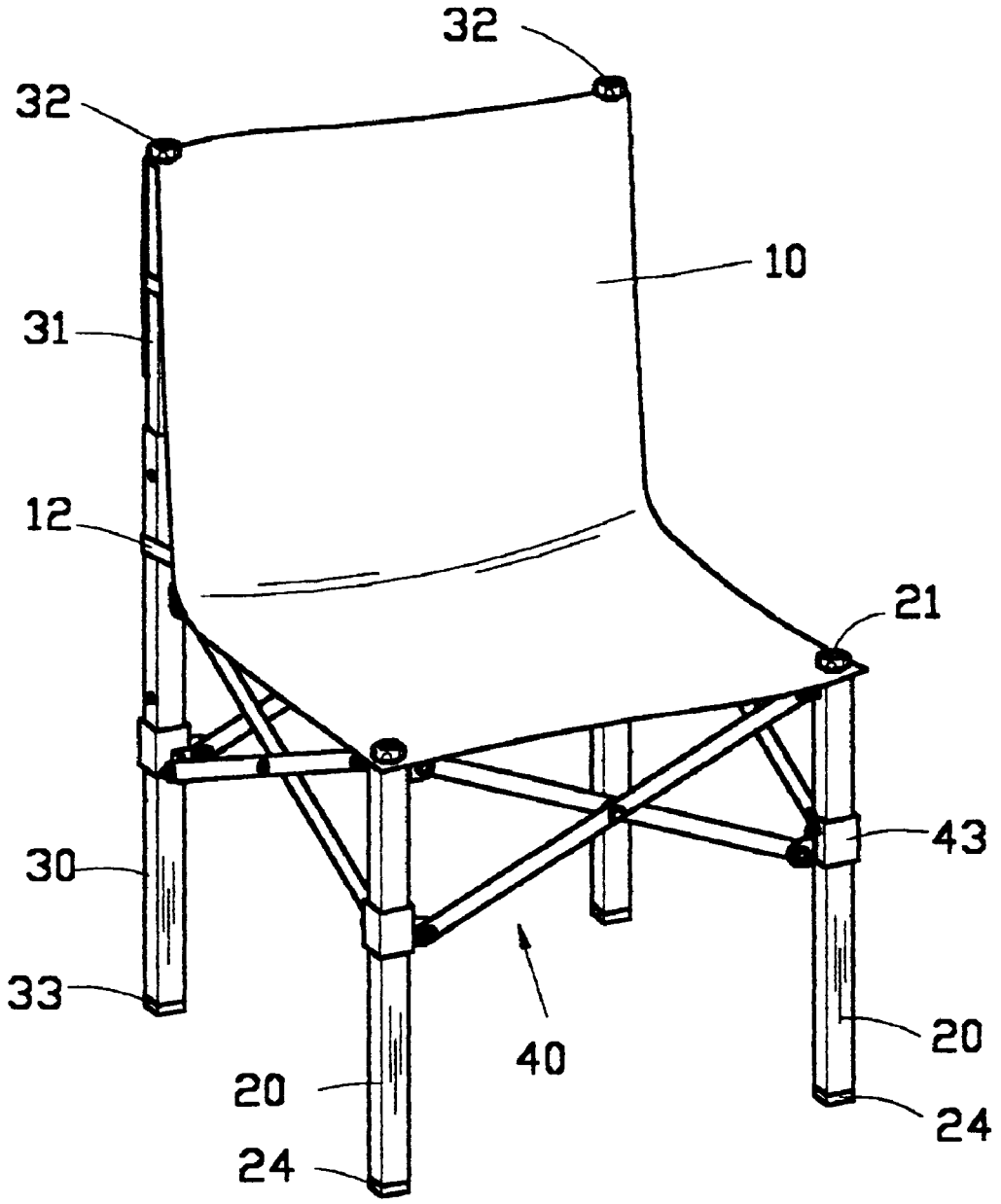
FIG. 1 is a perspective view of collapsible chair constructed in accordance with a first embodiment of the present invention.
Figure 2:
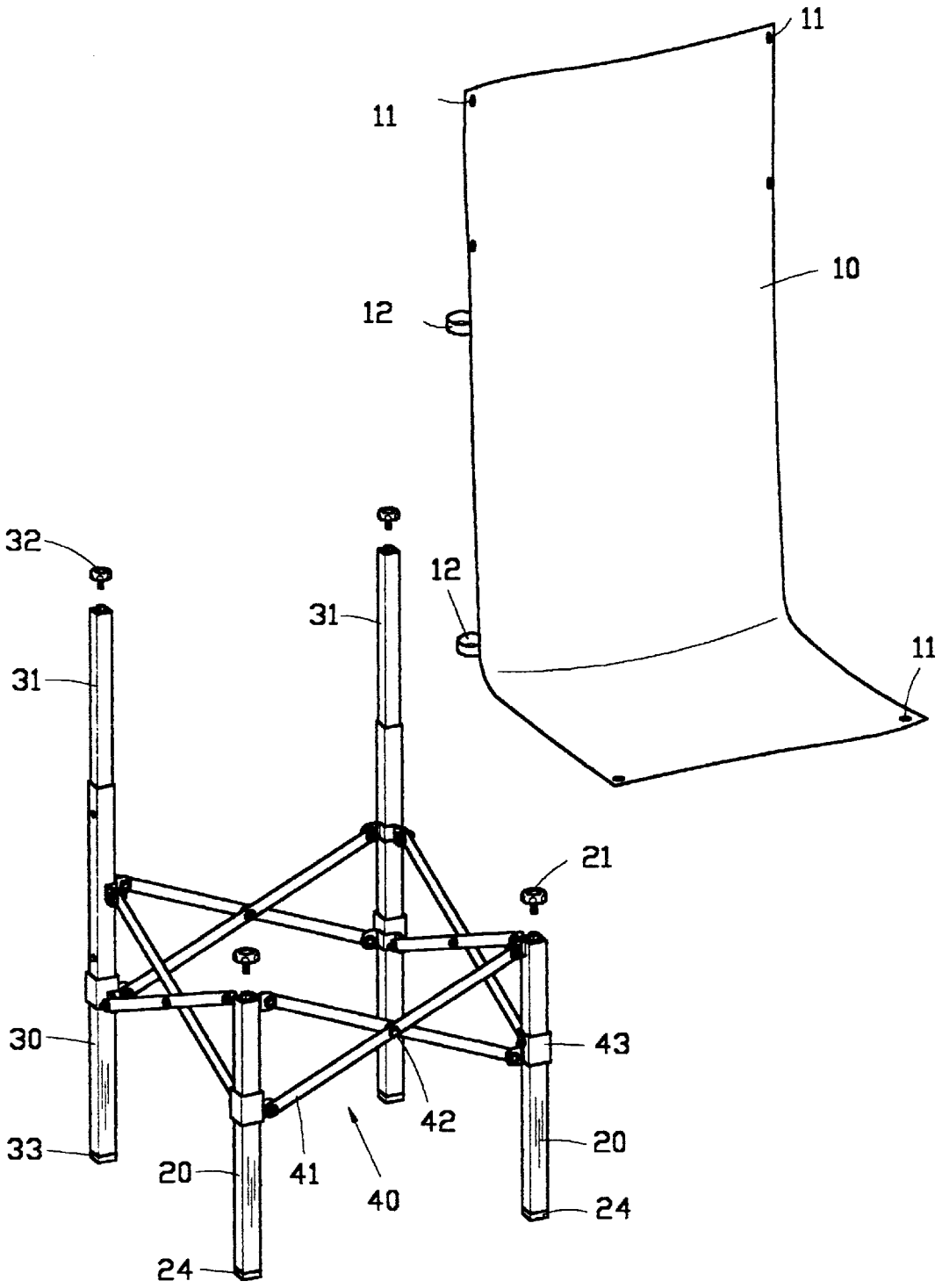
FIG. 2 is an exploded perspective view of the collapsible chair with a flexible seat member thereof detached from a chair frame.

With reference to the drawings and in particular to FIGS. 1 and 2, a collapsible chair constructed in accordance with the present invention comprises a chair frame comprising two front legs 20 and two rear legs 30 connected to each other by a connecting mechanism 40. A flexible sheet 10 is mounted to the chair frame to serve as a seat and a back of the chair.

The sheet 10 is made of for example tough fabrics, such as canvas, and in substantially rectangular having eyelets 11 formed in four corners thereof. If desired, at least one pair of additional eyelets 11 may be formed in the sheet 10 at desired positions. The eyelets 11 will be further described.

Figure 4:
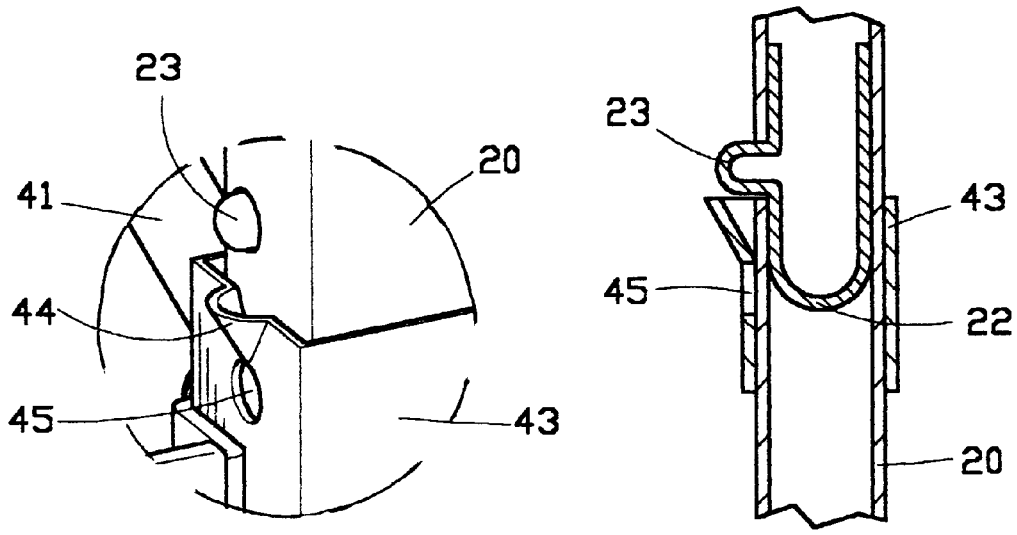
FIGS. 4 and 5 are partial cross-sectional views respectively showing a front retention device of the collapsible chair at a released condition and a locked condition.
Figure 5:
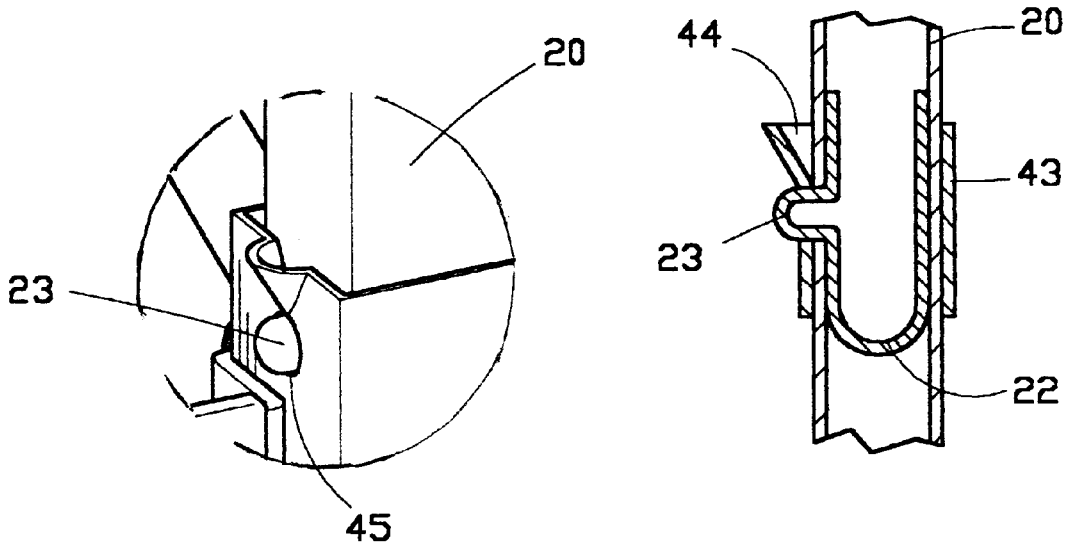

Each front leg 20 is made of a square or circular tube having a top end and an opposite bottom end. A bolt 21 is threadingly mounted to the top end of each front leg 20 and a cushion pad 24 is attached to the bottom end of the leg 20 for supporting the leg 20 on the ground. First retention means is arranged in each front leg 20 and comprises a first U-shaped leaf spring 22. Each first leaf spring 22 comprises a retention pin 23 mounted thereto. Preferably, the retention pin 23 is formed by a projection extending from the leaf spring 22. The retention 23 is movably received in a hole (not labeled) in the front leg 20 and biased by the first leaf spring 22 to partially project beyond the front leg 20 through the hole for engaging with the connecting mechanism 40 to retain the connecting mechanism 40 at an expanded position as shown in FIG. 4 and 5.

Figure 6B:
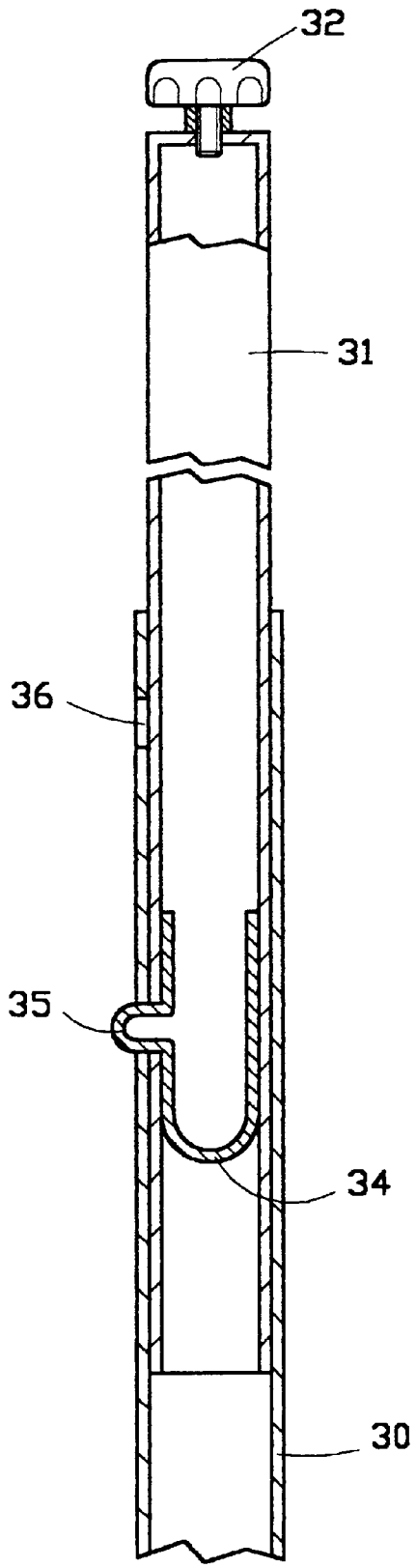
FIGS. 6A and 6B are partial cross-sectional views respectively showing a rear retention device of the collapsible chair at an extended position and a retracted position.
Figure 6A:
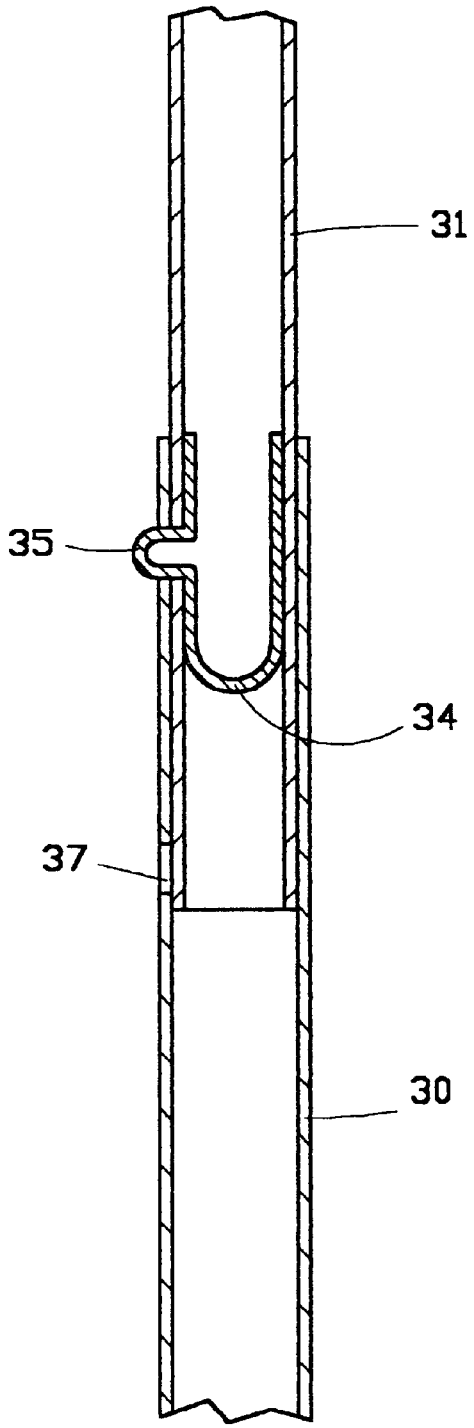

Each rear leg 30 comprises a square or circular tube telescopically receiving a tubular stile 31 therein. The stile 31 is movable with respect to the rear leg 30 between a retracted position (FIG. 6B) where the stile 31 is substantially received in the leg 30 and an extended position where the stile 31 substantially extends beyond the leg 30 through a top end thereof (FIG. 6A). To fix the stile 31 in the retracted position and the extended position, second retention means is arranged between the stile 31 and the corresponding rear leg 30. In the embodiment illustrated, the retention means comprises a second U-shaped leaf spring 34 fixed in each stile 31 and having a projection 35 extending therefrom to serve as a retention pin. The retention pin 35 is movably received in a hole defined in the stile 31 and is biased by the second leaf spring 34 beyond the stile 31 through the hole thereof for selectively engaging with retention holes 36, 37 defined in the rear leg 30. The retention holes 36, 37 correspond to the extended position and the retracted position whereby when the retention pin 35 engages with the retention holes 36, 37, the stile 31 is retained at the extended position and the retracted position. It is apparent that more than two retention holes may be defined in each rear leg 30 to retain the stile 31 at different locations with respect to the rear leg 30. This allows the chair of the present invention to have a height adjustable chair back. Cushion pads 33 are attached to the bottom ends of the rear legs 30.

Similar to the bolts 21 mounted to the top ends of the front legs 20, bolts 32 are releasably mounted to top ends of the stiles 31. The bolts 32, 21 extend through the eyelets 11 defined in four corners of the sheet 10 for fixing the sheet 10 to the chair frame. The additional eyelets 11 are formed corresponding to the retracted position of the stiles 31 whereby when the stiles 31 are retracted into the rear legs 30, the sheet 10 may be folded to have the bolt 32 extending through the additional eyelets 11 thus forming a lower chair back. Loops 12 are mounted to edges of the sheet 10 for receiving the stiles 31 and/or the rear legs 30 to attach the edges of the sheet 10 to the chair frame.

Figure 3:
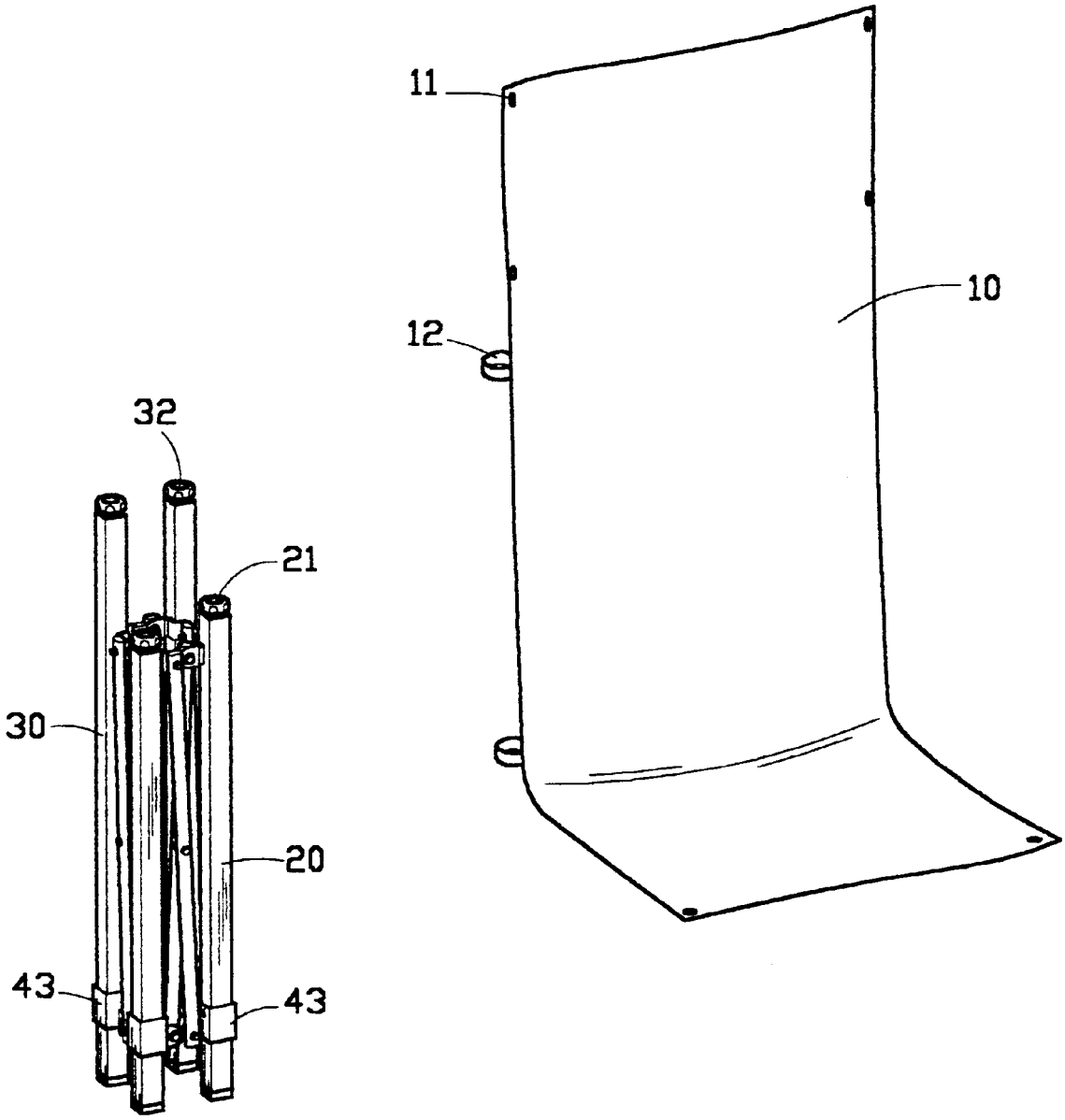
FIG. 3 is a similar to FIG. 2 but showing the chair frame completely collapsed.

The connecting mechanism 40 comprises a pair of pivoted link bars 41 between every two adjacent legs 20, 30 and a collar 43 slidably fit over each leg 20, 30 for being movable along the legs between an upper locked position (FIGS. 1 and 2) and a lower released position (FIG. 3). The link bars 41 are pivoted to each other at a center thereof to form a cross configuration. First ends of the link bars 41 are respectively pivotally attached to the two legs 20, 30 and second ends of the link bars 41 are pivotally attached to the collars 43. When the collars 43 are moved to the upper position, the legs 20, 30 are moved away from each other to an expanded position thereby expanding the chair frame and when the collars 43 are moved to the lower position, the legs 20, 30 converge and are moved toward each other to a collapsed position thereby collapsing the chair frame.

As shown in FIGS. 4 and 5, the collar 43 associated with each front leg 20 defines a hole 45 for receiving the retention pin 23 of the leaf spring 22 of the front leg 20 when the collar 43 is moved to the upper locked position. The engagement between the collar 43 and the retention pin 23 of the leaf spring 22 effectively retains the collar 43 at the upper locked position. An inclined guide passage 44 is formed in the collar 43 for guiding the retention pin 23 into the hole 45 of the collar 43. The inclination of the passage 44 moves the retention pin 23 against the leaf spring 22 into the front leg 20 when the collar 43 is moving toward the upper locked position and once the collar 43 reaches the upper locked position, the leaf spring 22 biases the retention pin 23 into the hole 45 of the collar 43 thereby fixing the collar 43 at the upper locked position.

To this point, it is clear that to expand the chair, the following steps are taken:

(1) moving the legs 20, 30 away from each other to the expanded position for expanding the chair frame until the retention pins 23 of the leaf springs 22 of the front legs 20 engage the holes 45 of the collars 43 to fix the collars 43, as shown in FIG. 2;

(2) extending the stiles 31 to the desired height with the retention pins 35 of the leaf springs 34 of the stiles 31 engaging the corresponding holes 36, 37 of the rear legs 30 for fixing the stiles 31; and (3) using the bolts 21, 32 to secure the sheet 120 to the top ends of the front legs 20 and the stiles 31 as shown in FIG. 1, while in collapsing the chair, the following steps are taken:

(a) releasing the bolts 21, 32 to remove the sheet 10 from the chair frame, the bolts 21, 32 being then attached back to the chair frame;

(b) retracting the stiles 31 back into the rear legs 30;

(c) releasing the collars 43 of the front legs 20 and moving the collars 43 to the lower released position for completely collapsing the chair frame and converging the legs; and (d) wrapping the legs 20, 30 with the sheet 10.

Figure 7:
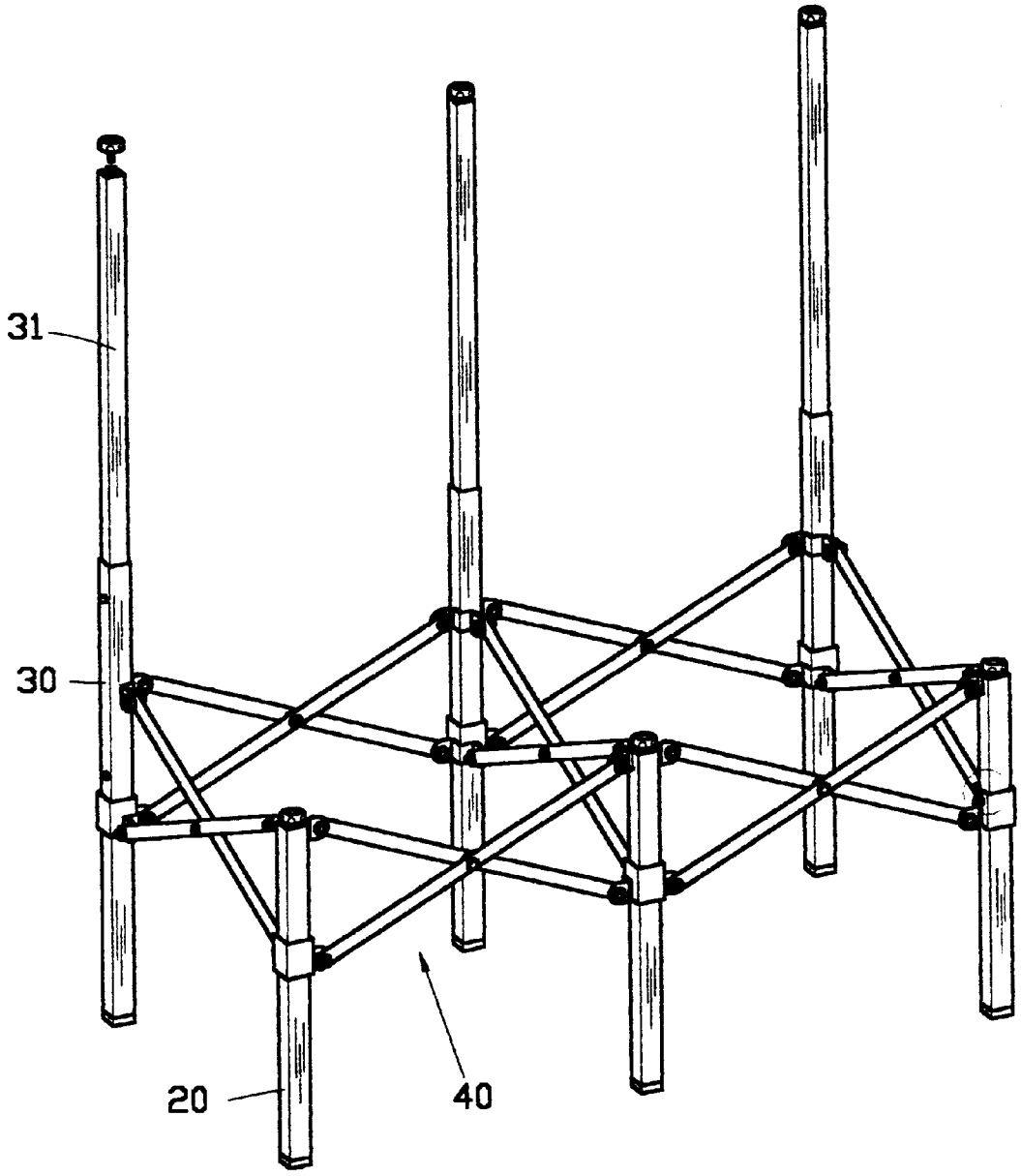
FIG. 7 is a perspective view showing a chair frame of a collapsible chair in accordance with a second embodiment at a fully expanded position.

FIG. 7 shows a second embodiment of the present invention wherein the chair frame comprises three front legs 20 and three rear legs 30. A connecting mechanism 40 is connected between the legs 20, 30 for allowing the chair frame to be collapsed to a minimum size. A sheet (not shown) may be attached to the chair frame by means of bolts (not shown) to serve as a chair seat and chair back.

Figure 8:
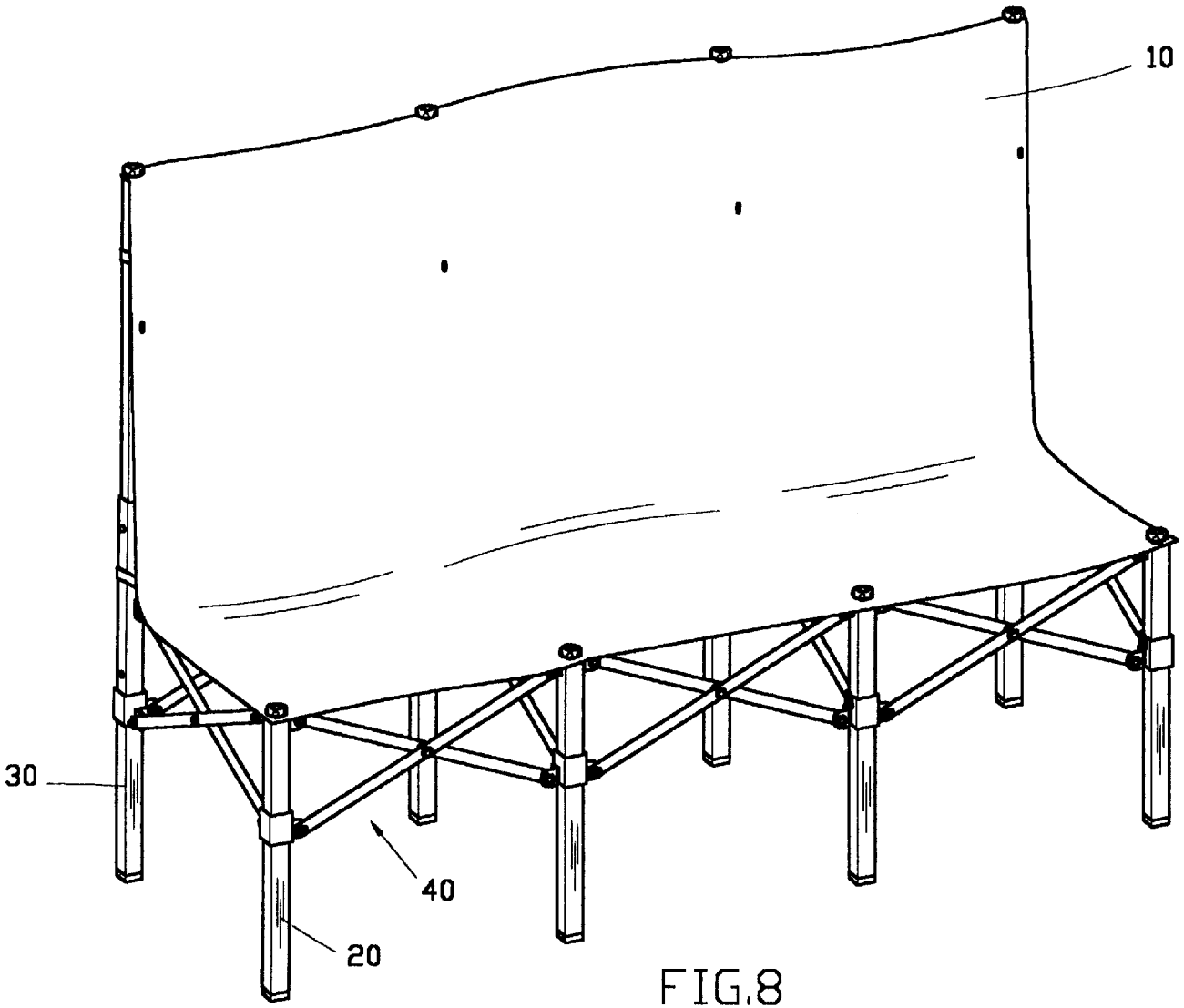
FIG. 8 is a perspective view of a collapsible chair constructed in accordance with a third embodiment of the present invention.

FIG. 8 shows a third embodiment of the present invention wherein the chair frame comprises four front legs 20 land four rear legs 30. A connecting mechanism 40 is connected between the legs 20, 30 thereby allowing the chair frame to be collapsed to a minimum size. A sheet 10 is attached to the chair frame by means of bolts (not labeled).

Although the present invention has been described with respect to the preferred embodiments, it is contemplated that a variety of modifications, variations and substitutions may be done without departing from the scope of the present invention that is intended to be defined by the appended claims.

What is claimed is:

1. A collapsible chair comprising:

A. a chair frame having an expanded and a collapsed positions thereof, said chair frame including:

at least two front legs and at least two rear legs, each said rear leg including a tubular member and a stile member telescopically received in said tubular member and movable between an extended position and a retracted position, in said extended position said stile member substantially extends beyond said tubular member, and in said retracted position said stile member is substantially completely received within said tubular member;

B. connecting means coupled to said front and rear legs, said connecting means including:

a) a plurality of front collars respectively movable along each of said front legs between a first position and second position, b) a plurality of rear collars respectively movable along each of said rear legs between a first position and a second position, c) a plurality of pairs of links, each said pair of links being interconnected in central pivotal relationship, a respective pair of said links being coupled between (i) adjacent front legs, (ii) between adjacent rear legs, and (iii) between corresponding front and rear legs, each said link being pivotally coupled on one end thereof to a respective one of said legs and on an opposing end to a respective one of said collars on a corresponding other one of said legs, whereby said chair frame is maintained in said expanded position when said front and rear collars are respectively positioned in said first positions said chair frame being maintained in said collapsed position when said front and rear collars are respectively positioned in said second positions, d) first retention means for respectively releasably retaining said front collars, in said first position thereof, and e) second retention means respectively arranged between said stile member and said tubular member of each said rear leg for selectively retaining said stile member in either one of said extended position and said retracted position, said second retention means including for each said rear leg, a retention pin received in a hole formed in a corresponding stile member, and a leaf spring arranged inside of said stile member and biasing said retention pin; and C. A flexible sheet releasably attached to said chair frame to form a seat.

2. The collapsible chair as claimed in claim 1, wherein said tubular member has a first hole and a second hole formed therein, and wherein said spring-biased retention pin is selectively engagable with either one of said first and second holes, thus maintaining said stile member in said extended position and said retracted position, respectively.

3. A collapsible chair comprising:

A. a chair frame having an expanded and a collapsed positions thereof, said chair frame including:
at least two front legs and at least two rear legs;

B. connecting means coupled to said front and rear legs, said connecting means including:

a) a plurality of front collars respectively movable along each of said front legs between a first position and second position, b) a plurality of rear collars respectively movable along each of said rear legs between a first position and a second position, c) a plurality of pairs of links, each said pair of links being interconnected in central pivotal relationship, a respective pair of said links being coupled between (i) adjacent front legs, (ii) between adjacent rear legs, and (iii) between corresponding front and rear legs, each said link being pivotally coupled on one end thereof to a respective one of said legs and on an opposing end to the respective one of said collars on a corresponding other one of said legs, whereby said chair frame is maintained in said expanded position when said front and rear collars are respectively positioned in said first positions said chair frame being maintained in said collapsed position when said front and rear collars are respectively positioned in said second positions, and d) retention means for respectively releasably retaining said front collars in said first position thereof, said retention means comprising a retention pin arranged within each said front leg and a leaf spring arranged within each said front leg for biasing said retention pin, each said retention pin extending through a first hole formed in a corresponding front leg and selectively engagable with a second hole defined in a corresponding front collar, thus releasably retaining said front collar in said first position; and C. a flexible sheet releasably attached to said chair frame to form a seat.

4. A collapsible chair comprising:

A. a chair frame having an expanded and a collapsed position thereof, said chair frame including:
at least two front legs and at least two rear legs;

B. connecting means coupled to said front and rear legs, said connecting means including:

a) a plurality of front collars respectively movable along each of said front legs between a first position and second position, b) a plurality of rear collars respectively movable along each of said rear legs between a first position and a second position, c) a plurality of pairs of links, each said pair of links being interconnected in central pivotal relationship, a respective pair of said links being coupled between (i) adjacent front legs, (ii) between adjacent rear legs, and (iii) between corresponding front and rear legs, each said link being pivotally coupled on one end thereof to a respective one of said legs and on an opposing end to the respective one of said collars on a corresponding other one of said legs, whereby said chair frame is maintained in said expanded position, when said front and rear collars are respectively positioned in said first positions said chair frame being maintained in said collapsed position when said front and rear collars are respectively positioned in said second positions, and d) retention means for respectively releasably retaining said front collars in said first position thereof, said retention means comprising a spring biased retention pin arranged within each said front leg and respectively extending through a hole formed in a corresponding front collar, thus releasably retaining said front collar in said first position thereof, and wherein each said front collar includes an inclined guide passage for guiding said retention pin into said hole formed in said front collar; and, C. a flexible sheet releasably attached to said chair frame to form a seat.

* * * * *